United States Patent [19]

Schafer et al.

[11] 4,023,484

[45] May 17, 1977

[54] BALING PRESS

[75] Inventors: Anton Schäfer, Langenfeld; Karl Probst, Solingen, both of Germany

[73] Assignee: Lindemann Maschinenfabrik GmbH, Dusseldorf, Germany

[22] Filed: May 11, 1976

[21] Appl. No.: 685,189

[30] Foreign Application Priority Data

May 30, 1975 Germany ..... 2523969

[52] U.S. Cl. ..... 100/215; 100/220; 100/240; 141/71

[51] Int. Cl.[2] ..... B30B 15/30

[58] Field of Search ..... 100/215, 220, 45, 240, 100/246, 252, 255; 141/248, 71, 73

[56] References Cited

UNITED STATES PATENTS

| | | | |
|---|---|---|---|
| 769,692 | 9/1904 | Davies | 100/215 |
| 2,955,529 | 10/1960 | Marble | 100/215 |
| 3,386,372 | 6/1968 | Knipp | 100/215 X |

FOREIGN PATENTS OR APPLICATIONS

| | | | |
|---|---|---|---|
| 379,378 | 8/1923 | Germany | 100/215 |
| 1,215,322 | 12/1970 | United Kingdom | 100/215 |

*Primary Examiner*—Billy J. Wilhite
*Attorney, Agent, or Firm*—Toren, McGeady and Stanger

[57] ABSTRACT

A baling press especially for fibrous materials comprises a press box with a filler box located above it, a plunger for moving the material to be baled out of the filler box into the press box, and retaining fingers which prevent material moved by the plunger from returning. The filler box has two opposite fixed walls and two hinged opposite walls which are located between the fixed walls and which are capable of pivoting through a small angle relative to the axis of the press box when the plunger is withdrawn. The axes of the hinges of the hinged walls are fixed and extend transversely to the axis of the press box, so that, in use, material to be baled is fed through the filler box with its hinged walls inclined to the axis of the press box, and then with the hinged walls of the filler box aligned with the press box the plunger moves the material from the filler box into the press box.

5 Claims, 2 Drawing Figures

BALING PRESS

This invention relates to a baling press which has a press box with a filler box mounted above it and which is particularly intended for baling fibrous materials. Such presses frequently have a number of successively operating press box combinations which are pivotal about a vertical axis, but at their simplest merely have a single press box with a filler box mounted above it. The invention is applicable in either case.

The primary difficulty of the design of such baling presses is the fact that the filler box cannot be filled from its top, because the plunger is in the way. The plunger may be either a pre-pressing plunger or a plunger which produces the final pressure. The filler box is usually filled from the side through a filler opening provided in one of its walls. This sideways introduction of the fibres results in the fibres being heaped up at one side of the press with the heap higher on the filler side than on the opposite side of the filler box. The greater the distance between the wall containing the filler opening and the opposite wall, the greater is this difference in height due to the angle of repose of the fibres. After pressing, the fibre density at the corresponding side of the press box is therefore considerably larger than the density at the other side. This results in a highly eccentric loading being present on the plunger and its drive, particularly because of the large working area of the plunger, and this leads to premature wear of the guides of the piston rod.

Under the action of the pressing plunger operating in the press box, bales are produced, as always, which have the same cross-sectional shape as the press box. However, as soon as the finished bale is removed from the press box, the result of the difference in fibre density, which is, of course, still present, is a bale having an uneven shape, since the material expands after the pressure is relieved and the magnitude of the expansion is a function of the fibre density. This still occurs even when the finished bales are banded whilst they are still inside the press, because the banding yields under the expansion forces acting in the bale.

Sucn an uneven distribution of the fibre density has a very adverse effect particularly in those baling presses which include a provision whereby the determination of the weight of the bale is taken as a function of the magnitude of the pressure which the fibres in the press box exert upon the fully extended pre-pressing plunger. A fibre density which is high only locally results in a correct weight signal due to the pressure obtaining at the drive of the pre-pressing plunger, when actually the required weight of fibres is not contained in the press. This circumstance leads to objections to the bales on the part of the purchaser, because it is difficult to incorporate bales of uneven weights in a further automatic processing operation.

Even more serious than the lack of uniformity in density, which in some cases may be acceptable, is that, the filler box must not be overfilled on conventional baling presses. If this is done a mat-like structure of the fibres remains bridging the transition from the transversely entering filler shaft into the filler box. This mat-like structure may be perforated or torn during the next downward stroke of the plunger, provided that the plunger drive is powerful enough, but it may not be, and in that case it would make the fibre quality of the resultant bale unserviceable. It is frequently specified that all fibres within a bale shall possess practically the same length. Extreme care must therefore be taken to ensure that the filler box is not overfilled, so that no fibres at all bridge the transition between the filler box and the press box before the downward stroke of the plunger. In turn this means that a large number of fillings and plunger strokes is necessary to introduce a sufficient quantity of fibres into the press box for one bale. However, even in the exceptional cases where it is permissible to allow bridging fibres to be squashed and severed by the downwardly travelling plunger, there is still the objection of the high eccentric loadings which are transmitted through the comparatively large working area of the pressing plunger onto its drive, causing a premature wear of the piston rod guides.

According to this invention a baling press comprises a press box with a filler box located above it, a plunger for moving material to be baled out of the filler box into the press box, and retaining fingers which prevent material moved by the plunger from returning, the filler box having two opposite fixed walls and two hinged opposite walls which are located between the fixed walls and which are capable of pivoting through a small angle relative to the axis of the press box when the plunger is withdrawn, the axes of their hinges being fixed and extending transversely to the axis of the press box, so that, in use, material to be baled is fed through the filler box with its hinged walls inclined to the axis of the press box, and then with the filler box aligned with the press box the plunger moves the material from the filler box into the press box.

A baling press in accordance with this invention has structural advantages and considerable functional advantages as the column of material to be pressed is situated between the hinged walls it is moved into an upright stack before any transverse compaction of the material takes place as the walls are swung back into alignment with the box. Thus the material fills the filler box and the press box uniformly and the difficulties which arise in known baling presses due to the formation of a heap of material at one side are eliminated.

Also the filler box, which previously had to be completely emptied before each plunger stroke can now be used for holding material to be pressed. This is due to the transverse edge at the intersection of the filler box and the press box being eliminated before the material is moved by the plunger. Accordingly it is no longer possible for overhanging and mat-forming material to collect in the long run, because such an accumulation disappears immediately the hinged walls are brought into alignment with the press box to carry out the plunger stroke. This means a much smaller number of filler strokes of the plunger are required to fill the press with a quantity of material sufficient for one finished bale because the filler box itself is not counted as part of the filled volume of the press.

An example of a baling press accordance with this invention is shown in the accompanying drawings, in which.

Figure 1:
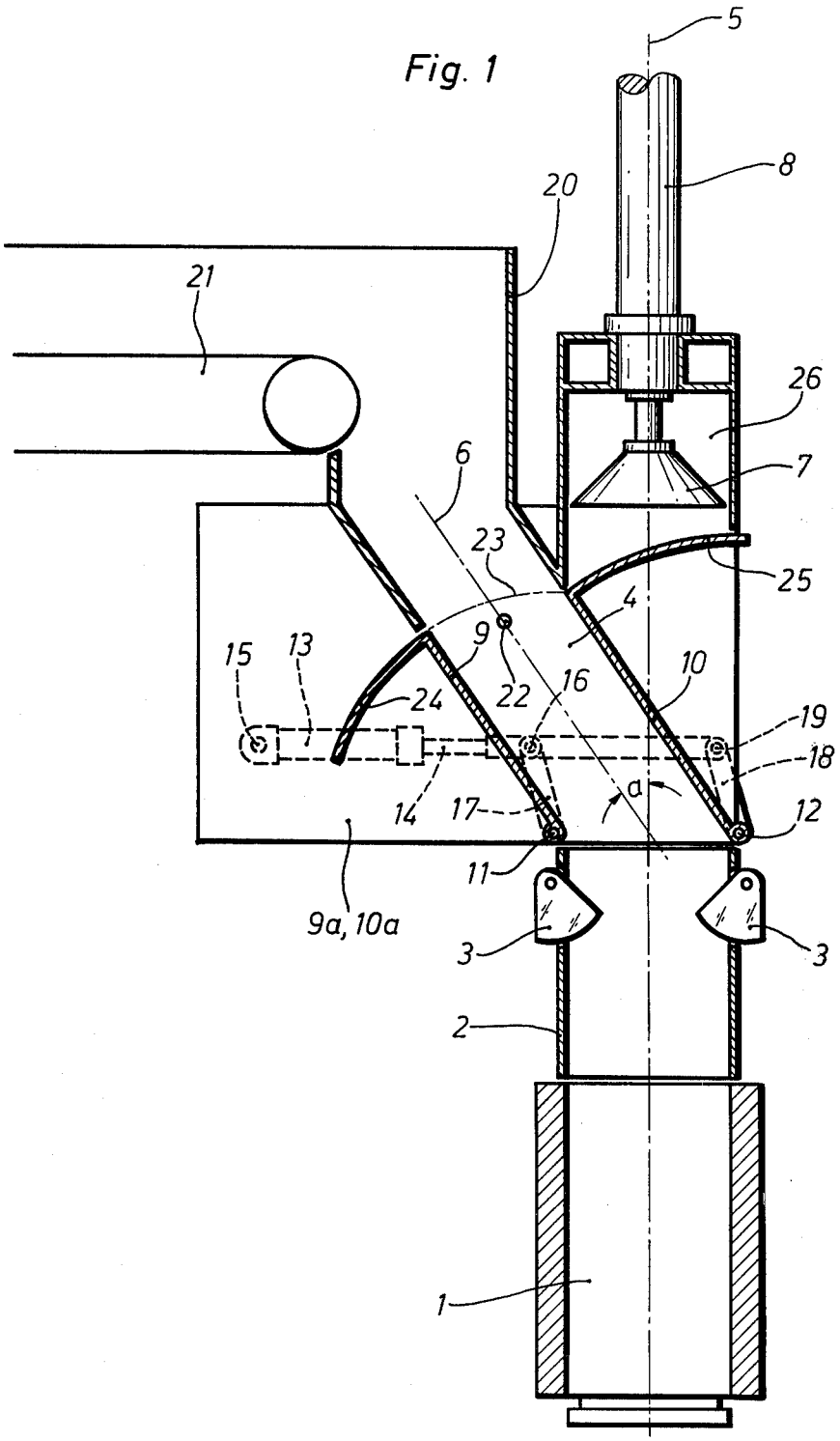
FIG. 1 is a vertical section through the press during filling.

A baling press for baling fibres consists of a press box 1, from which the finished bale is removed after each complete pressing operation, an intermediate box 2, mounted above and in alignment with the press box 1, holding fingers 3 which prevent the filled and pre-pressed material from moving backwards, and a filler box 4 which is positioned above the intermediate box 2. The filler box 4 by contrast to the known forms of construction, is not in a fixed position with respect to the boxes 1 and 2, but may be swung outwards laterally relative to an axis 5 of the press box through an acute angle *a*, so that the axis 6 of the filler box 4 is then no longer aligned with the axis 5. A pressing plunger 7 with a hydraulic piston and cylinder drive assembly 8 is movable along the axis 5. In this example the plunger 7 serves both as a filling plunger and also as the pressing plunger, which exerts the final pressure on the material to complete the bale.

The filler box 4 consists of two opposite hinged walls 9 and 10, which share a common drive and include hinges 11 and 12 respectively. The common drive includes a hydraulic piston and cylinder 13 coupled to a piston rod 14. The cylinder 13 is pivoted about a pivot 15 and the piston rod 14 is connected by a pivot 16 to the free end of a lever 17 and by a pivot 19 to a lever 18. The levers 17 and 18 are firmly connected to the side walls 9 and 10 respectively so that movement of the piston in the cylinder 13 causes the hinged walls 9 and 10 to move but to remain parallel at all times.

The side walls of the filler box 4 which are perpendicular to the hinged walls 9 and 10 are formed by fixed plates 9*a*, 10*a*, against which the longitudinal edges of the hinged walls 9 and 10 rest. Since the hinges 11 and 12 are located immediately adjacent to the upper edge of the intermediate box 2, the bottom edge of the filler box 4 and the intermediate box 2 are always in registry, without special auxiliary means, irrespective of the position of the filler box 4.

Fibres are introduced into the filler box 4 through a shaft 20 which is in part bounded by the plates 9*a*, 10*a*. Material is fed into the shaft 20 by a conveyor belt 21. The belt 21 may also serve as a so-called metering belt weighing machine, which is however of importance for the invention only to the extent that the supply of the material must at least have an upper limit, in order to avoid overfilling. The same purpose is served by a light beam 22 adjacent to the upper inlet opening 23 of the filler box 4. The light beam responding and interrupting the supply of material as soon as the material reaches the level of the beam.

Shields 24 and 25 are rigidly attached to the hinged walls 9 and 10 of the filler box 4. The shields 24 and 25 are curved about the axes of the hinges 11 and 12 respectively. In the position shown in FIG. 1, the shield 25 prevents access to the space 26, in which in the plunger 7 is situated. The shield 24 closes the outlet of the shaft 20, when the filler box is in the position in FIG. 2, so that material is retained in the shaft 20. During filling, the filler box moves into the positions shown in FIG. 1 and in this position the material passes from the belt 21 directly into the boxes 1, 2 and 4. The filler box 4 is then brought back into the position shown in FIG. 2 and the plunger 7 is moved down to pre-compact the previously introduced material. The filler box is then returned to the position shown in FIG. 1 to accept further material for transfer into the boxes 1 and 2 and it is then again swung back into the position shown in FIG. 2. These operations are repeated until the boxes 1, 2 and 4 contain a quantity of material equal to that to be included in one bale. During the pivotal motion of the filler box 4, the plunger 7 of course remains in the upward, withdrawn position, so that it does not obstruct the movement of the filler box 4.

Figure 2:
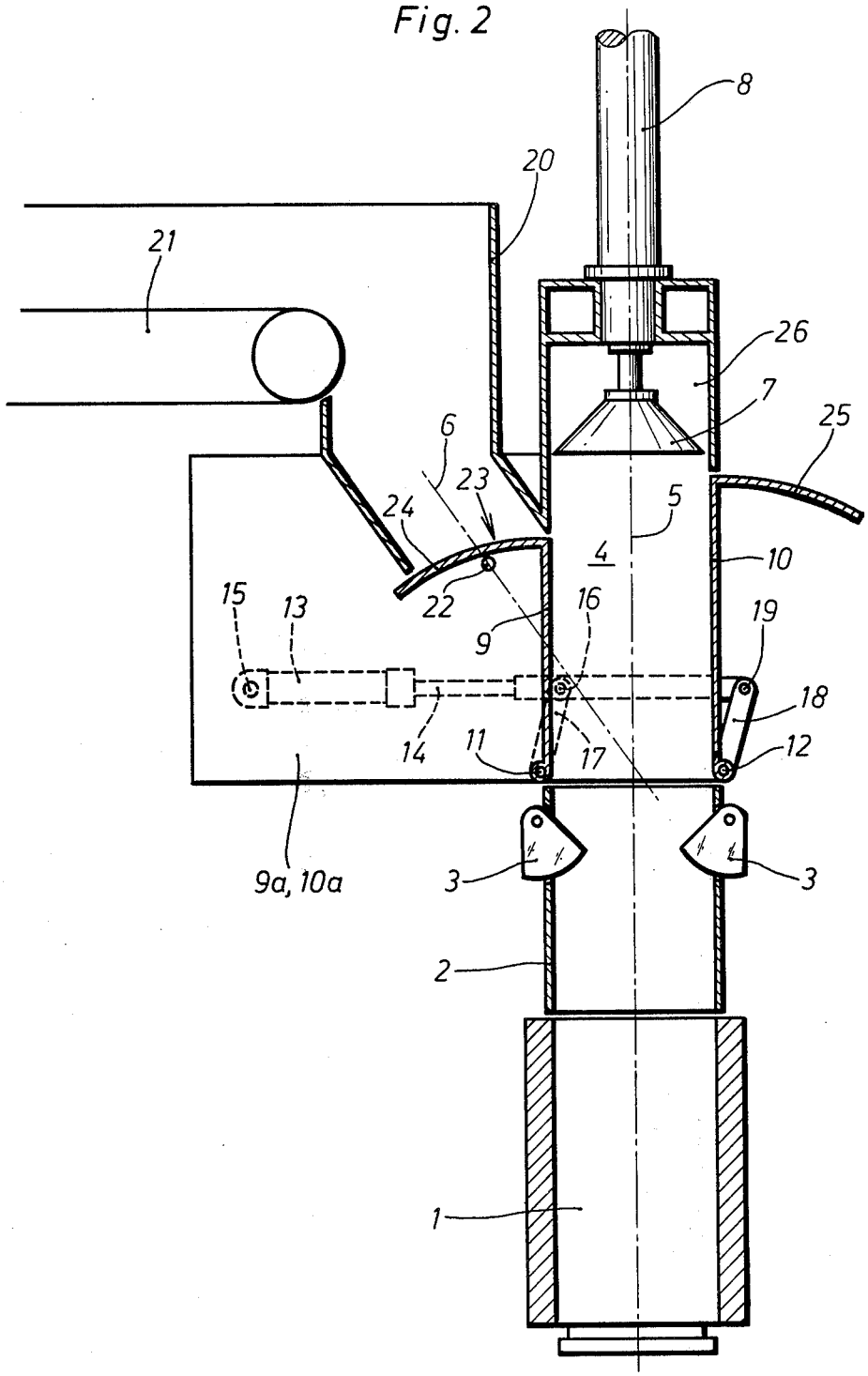
FIG. 2 is a similar view during pressing.

When the boxes 1, 2 and 4 are filled sufficiently to enable a bale having the specified weight to be pressed from them, all the parts are brought into the position according to FIG. 2, whereupon the plunger 7 is brought downwards completely and past the fingers 3, to press the filled-in quantity of material into a finished bale in the press box 1. The bale is then removed from the press, for example by moving the press box 1 out sideways or, if the walls of the press box are formed by doors, by opening it sideways. During this, the introduction of further material is prevented by the left-hand shield 24. A complete pressing operation is thereby concluded.

In fibre baling presses, it is quite common for one plunger to be provided for the filling and pre-pressing and another for the final pressure which forms the bale with a large force. This applies especially in those cases, in which a press contains several box combinations, which come into operation successively by the filling and pre-pressing being carried out in one press and the final pressure being exerted in another press. In the simple press selected here as an example, this will not usually be necessary. In a single-box press, as it may be termed here, the same procedure can equally well be used. It would then be necessary to provide an abutment in the press box against which the principal plunger entering the press box from below would act and provide for the abutment only to come into action at the end of each pressing operation to complete the bale. The way this could be done is obvious and does not need to be explained in more detail.

We claim:

1. In a baling press comprising a press box with a filler box located above it, a plunger for moving material to be baled out of said filler box into said press box, and retaining fingers which prevent said material moved by said plunger from returning the improvement wherein said filler box comprises two opposite fixed walls, two opposite hinged walls located between said fixed walls and capable of pivoting through a small angle relative to the axis of said press box when said plunger is withdrawn, and hinges attached to said hinged walls, the axes of said hinges being fixed and extending transversely to said axis of said press box, whereby said press is filled through said filler box with its hinged walls inclined to said axis of said press box, and then with said hinged walls of said filler box aligned with said press box said plunger moves said material from said filler box into said press box.

2. The baling press of claim 1, wherein a first shield is fixed on one of said hinged filler box walls, said first shield preventing material entering said filler box when said hinged walls are aligned with said press box.

3. The baling press of claim 1, wherein a shield is fixed on one of said hinged side walls, said shield obstructing movement of said plunger when said hinged walls of said filler box are not aligned with said press box.

4. The baling press of claim 2, wherein a second shield is fixed on the other of said hinged side walls, said second shield obstructing movement of said plunger when said hinged walls of said filler box are not aligned with said press box.

5. The baling press of claim 1, wherein said two fixed walls of said filler box extend over a larger region than encompassed by said hinged walls.

* * * * *